United States Patent [19]

Erikson

[11] 4,358,017

[45] Nov. 9, 1982

[54] MAIL DIRECTION SYSTEM

[75] Inventor: Rolf B. Erikson, Highland Park, Ill.

[73] Assignee: Bell & Howell Company, Chicago, Ill.

[21] Appl. No.: 199,180

[22] Filed: Oct. 21, 1980

[51] Int. Cl.[3] ..... B07C 5/00

[52] U.S. Cl. ..... 209/584; 209/900; 235/494

[58] Field of Search ..... 209/584, 3.3, 569, 900; 235/494, 101, 380, 470; 250/223 R, 555–557, 559; 414/134, 135, 136

[56] References Cited

U.S. PATENT DOCUMENTS

| | | | |
|---|---|---|---|
| 2,709,001 | 5/1955 | Stahl | 209/3.3 X |
| 2,775,405 | 12/1956 | Paston | 209/900 X |
| 3,040,323 | 6/1962 | Brenner et al. | 209/3.3 X |
| 3,645,391 | 2/1972 | Hirakawa et al. | 209/3.3 |
| 3,757,942 | 9/1973 | Gunn | 209/3.3 |
| 3,774,758 | 11/1973 | Sternberg | 209/3.3 |

*Primary Examiner*—Allen N. Knowles

*Attorney, Agent, or Firm*—Griffin, Branigan & Butler

[57] ABSTRACT

An addressee's internal mail is accompanied by a director card having machine readable indicia placed thereon for identifying the given addressee. A carrier, holding the addressee's mail and director card is passed under an optical character reader which passes a signal to look-up table apparatus for generating a mail stop signal corresponding to the addressee. Mail director apparatus is then operative in response to the mail stop signal to direct each piece of mail to the desired addressee.

11 Claims, 4 Drawing Figures

FIG. 1
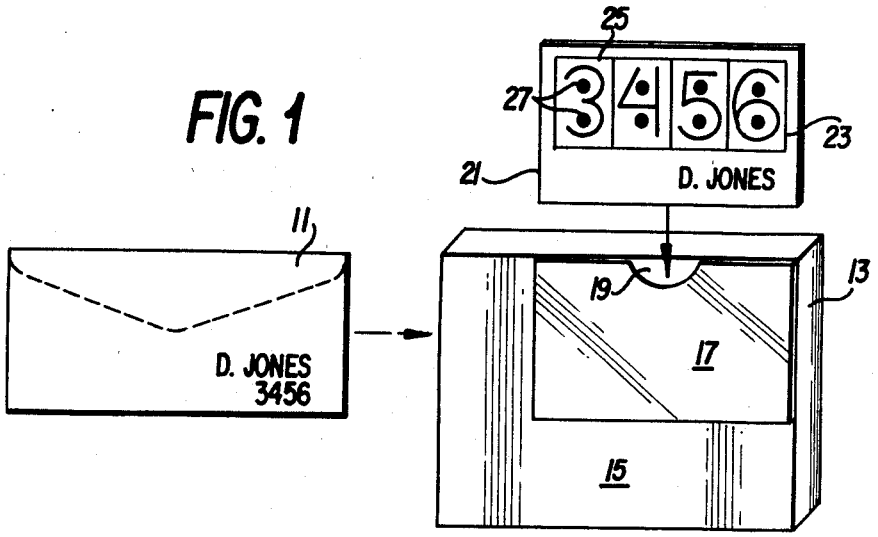
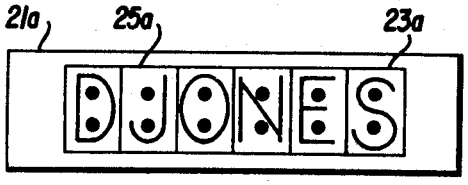
FIG. 2
FIG. 3
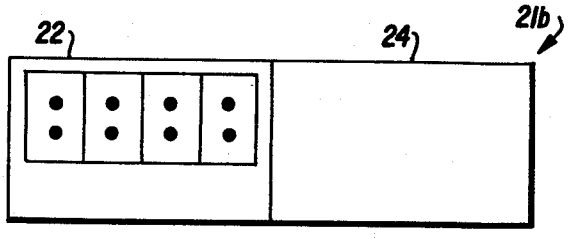
FIG. 4
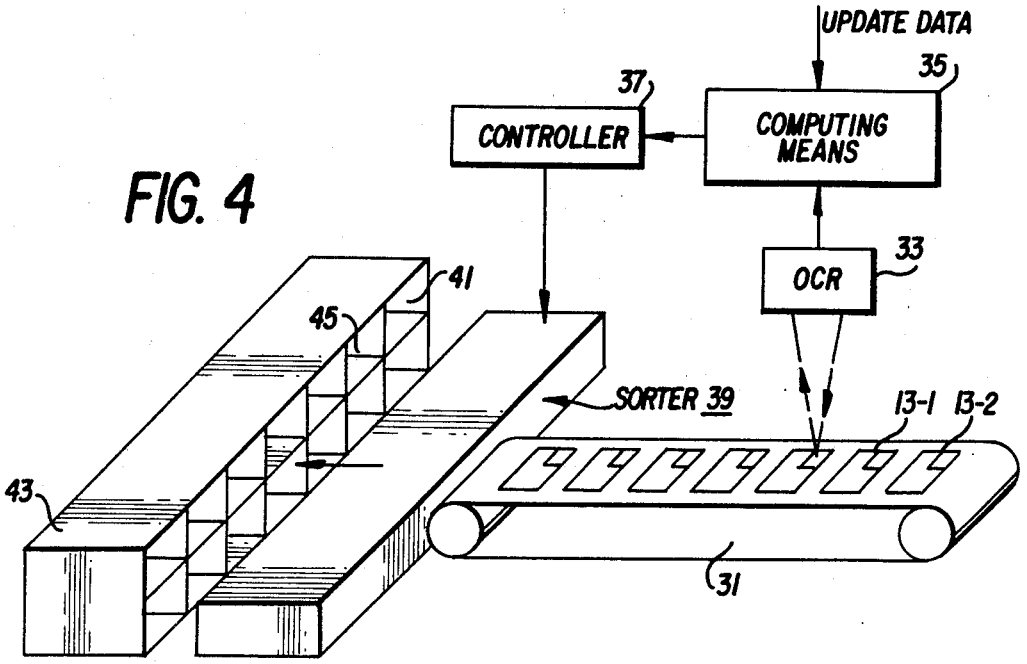

MAIL DIRECTION SYSTEM

BACKGROUND OF THE INVENTION

This invention relates to mail direction systems and, more particularly, to systems having particular utility in such organizations as corporations or government locations where internal mail is directed to various "mail stops" throughout a facility.

"Mail stops" are often changed from time-to-time for given individuals within an organization, but such changes are not generally known by persons writing to such individuals. Indeed, the writers usually do not know the mail stops of the individuals to whom they are writing. That is, it is usually left up to the organizaton's mailroom to assign mail stops to each piece of internal mail that is directed through the mailroom. It is an object of this invention, therefore, to provide a mail direction system wherein mail can be automatically directed to an individual's mail stop without the sender knowing the identity of that mail stop; and, without the organization's mailroom personnel having to make individual mail stop assignments.

An advantage of structure in accordance with the invention is that mail stop changes can be easily updated so that the mail can be automatically directed to the intended recipient even though the writer is not even aware that the recipient's mail stop has been changed.

Another advantage of a preferred embodiment about to be described is that the recipient's telephone extension—a number often familiar to the writer—can provide the basis for automatic direction of the recipient's mail to the recipient's current mail stop.

SUMMARY

In accordance with principles of the invention, a person sending internal mail to an addressee marks a director card with indicia, such as the addressee's telephone extension. The direction card and the corresponding mail are placed in a carrier which is directed under a character recognition device for reading the indicia and sending indicia signals to computing means having a look-up table or the like which assigns the addressee's current mail stop in accordance with the indicia on the director card. A controller is then operative in response to mail stop signals from the computing means to direct the particular addressee's mail to the proper mail stop.

BRIEF DESCRIPTION OF THE DRAWING

The foregoing and other features, objects, and advantages of this invention will be apparent from the more particular description of preferred embodiments thereof as illustrated in the accompanying drawings wherein the same reference numerals refer to the same elements throughout the various views. The drawings are not necessarily intended to be to scale, but rather are presented to illustrate principles of the invention in a clear form.

In the drawings:

FIG. 1 is a schematic illustration of an envelope, a director card, and a carrier for use in accordance with a preferred embodiment of the invention;

FIG. 2 is a schematic illustration of an alternate form of a director card illustrated in FIG. 1;

FIG. 3 is a schematic illustration of yet another alternate form of a director card illustrated in FIG. 1; and, FIG. 4 is a schematic illustration of apparatus for operating upon the structure of FIGS. 1, 2, or 3.

DETAILED DESCRIPTION

A message to be directed to a desired individual or department is preferrably placed within an envelope or the like 11 (FIG. 1) for insertion into a carrier 13 which may, for example, simply be a large envelope. In a preferred embodiment, however, the carrier 13 is fabricated from a relatively sturdy material such as a somewhat flexible plastic or cardboard jacket of about 10 mils thickness. Alternatively, the message to be sent may be placed directly into the carrier 13 without first being placed in a container such as envelope 11.

In the illustrated embodiment at least the upper right hand corner of the carrier's front portion 15 is relatively opaque, but is covered by a clear plastic pocket 17 having a thumb recess 19 therein. A director card 21 has a director block 23 thereon to accommodate character recognition indicia to be described more fully shortly.

When a writer desires to direct a communication to a recipient, he simply places it in the carrier 13 (preferrably in an envelope 11) and completes a director card 21. The illustrated director card employs a "double dot" form of character application wherein the sender, in the FIG. 1 embodiment, places the recipient's telephone extension in suitable indicia locations 25 of the director block 23 so that the digits of the telephone number are written around or adjacent the illustrated double dots such as 27. FIG. 1 also illustrates the recipient's name being written on the director card, but in the FIG. 1 embodiment only the recipient's telephone extension is machine readable—the recipient's name is not.

After the director card 21 is completed by the sender, it is inserted into the pocket on the carrier 31 formed between the clear plastic panel 17 and the carrier's opaque portion of the front surface 15.

As illustrated in FIG. 2, the director card 21 can be alternatively provided with sufficient indicia or character locations 25*a* to accommodate the recipient's first initial and last name in director block 23*a* of a director card 21*a*. As a still further alternative the sender can use the recipient's employee number, or the like, which would not normally change no matter how often the recipient's own extension or mail stop might be changed. It has been found, however, that most senders in fact know the current telephone extension of persons with whom they communicate. Hence, as a general rule, the use of telephone extensions in the director blocks 23 is quite satisfactory and, tends to require fewer character locations 25 than if recipients' names are used as in the FIG. 2 embodiment.

FIG. 3 illustrates still another embodiment of a director card for use with the invention. Therein the card 21*b* has two character application areas 22 and 24. The first area 22 corresponds to the director card of FIG. 1 in that it includes the same type of "double dot" character application structure. Area 24, on the other hand, accommodates machine written characters such as from a typewriter. Hence, a destination code (such as a phone extension) can be either machine written in area 24 or placed in area 22 by hand by the user.

After the communication-containing carriers 13 are delivered to the mailroom of a typical corporate facility, they are placed upon an endless conveyor or the like 31 for passage under an optical carrier recognition mechanism (OCR) 33. The OCR then "reads" the characters placed upon each director card 21 (or 21*a* or 21*b*)

and transmits signals corresponding to the detected characters to computing means 35 which correlates the indicia in the character locations 23 (whether they be the recipient's phone extension, name, or employee number) with the recipient's current mail stop and generates suitable "mail stop" or other destination signals.

When the FIG. 3 director card embodiment is employed the OCR first scans area 22 to read any "double dot" indicia or the like that might be employed. If area 22 has no such indicia the OCR is programmed to immediately scan area 24 for the machine written destination indicia thereon. In either event the OCR reads the destination indicia on the card 21*b* and transmits signals corresponding to the detected characters to the computing means 35 as discussed above.

The destination signals from the computing means are transmitted to a controller 37 which sequences a sorter 39 to direct each carrier 13 to its proper bin such as 41 of a mail delivery mechanism 43. If the communication in carrier 13-1 of FIG. 4, for example, is intended to be directed to the mail stop corresponding to bin 41, the OCR 33, computer 35, controller 37, and sorter 39 are operative to direct that particular carrier 13-1 (and contents) into bin 41. Similarly, if carrier 13-2 is intended to be directed to a mail stop corresponding to bin 45, the same structure insures that carrier 13-2 is deposited in bin 45. Structure such as the controller, sorter, and mail delivery mechanism 43 are state-of-the-art, however, and will not be further described except to note that the mail delivery device 43 is preferrably an automated mail delivery device such as one sold under the trademark "MAILMOBILE". That is, a device for automatically travelling the corridors of a corporate building and delivering mail to varius offices therein without the need for human intervention.

From the above description it will be apparent that the invention provides structure wherein mail can be automatically directed to an intended recipient's mail stop with mere application by the sender of the recipient's telephone extension or the like. Moreover, the state of the art for look-up tables in computers such as 35 permits rapid, simple updating to automatically account for mail stop changes of given recipients; or, even the automatic electronic correction of telephone extension numbers where recent extension changes of a given recipient might not be known to the sender. This feature, of course, has certain limitations, but is quite satisfactory where former extension numbers are not too rapidly reassigned.

Additionally, where the sender's telephone extension is also included on the director card 21 for interpretation by the OCR 33, the controller can be used to direct an extension-change notice to the sender (by means not shown) in the event of a change in the recipient's extension.

While the invention has been particularly shown and described with reference to preferred embodiments thereof, it will be understood by those skilled in the art that various changes in form and details may be made therein without departing from the spirit and scope of the invention. Other types of character recognition devices can be employed, for example, instead of the illustrated OCR 33.

Embodiments of the invention in which an exclusive property or privilege is claimed are defined as follows:

1. A mail direction system comprising:

a director card having indicia-receiving means thereon for receiving machine readable indicia identifying a given addressee;

carrier means for holding said director card and associated mail for said addressee;

character recognition means for reading said machine readable indicia and generating indicia signals representing said indicia;

means including look-up table means for receiving said indicia signals and generating mail stop signals corresponding to said indicia signals; and, directing means operative in response to said mail stop signals for directing said carrier and the mail therein to the mail stop associated with said addressee.

2. The apparatus of claim 1 including means for updating said look-up table means in response to changes in said addressee's mail stop.

3. Apparatus of claim 1 including:

means to update said look-up table means to change the mail stop information therein in response to changes in the mail stop for a given addressee;

a transparent pocket on said carrier for holding said direction card for recognition of the indicia thereon through said transparent pocket by said character recognition means;

conveyor means for moving a plurality of said carriers in seratim relative to said character recognition means; and wherein, said directing means includes a sorter for receiving said plurality of said carriers from said conveyor and sorting said plurality of carriers into groups corresponding to the mail stops for the addressees of the mail in said carriers.

4. The mail direction system of claim 3 wherein said indicia correspond to the telephone extension number of given addressees.

5. Apparatus of claim 1 wherein said carrier means includes a transparent pocket for holding said direction card.

6. The mail direction system of claim 1 wherein said machine readable indicia correspond to said addressee's telephone extension.

7. A mail direction system of claim 1 including a conveyor means for moving a plurality of said carriers relative to said character recognition means so that the machine readable indicia in said plurality of said carriers is read in seratim by said character recognition means.

8. The mail direction system of claim 7 wherein said directing means includes a sorter; and, wherein said conveyor means delivers said plurality of said carriers in seratim to said sorter.

9. The mail direction system of claims 1, 2, 3, 4, 5, 6, 7, or 8 wherein said character recognition means is adapted to optically read said machine readable indicia.

10. The mail direction system of claim 1 wherein said indicia-receiving means comprises at least two areas wherein the first area is adapted to receive handwritten characters and the second area is adapted to receive machine-written characters.

11. The system of claim 10 wherein said character recognition means includes means to selectively read both handwritten and machine-written characters; said character recognition means being adapted to first read one of said areas and, if no indicia are present thereon, to then read said other area.

* * * * *